United States Patent [19]

Deffontaine

[11] 3,991,579

[45] Nov. 16, 1976

[54] SELF ADVANCING SUPPORT CHOCKS

[75] Inventor: Pierre Deffontaine, Wittenheim, France

[73] Assignee: Mines De Potasse D'Alsace S.A., Mulhouse, France

[22] Filed: Dec. 2, 1974

[21] Appl. No.: 528,641

[30] Foreign Application Priority Data

Nov. 30, 1973 France ..... 73.42655

[52] U.S. Cl. ..... 61/45 D; 248/357

[51] Int. Cl.[2] ..... E21D 15/44

[58] Field of Search ..... 61/45 D, 63; 299/31, 299/33; 248/357; 91/170 MP

[56] References Cited

UNITED STATES PATENTS

| | | | |
|---|---|---|---|
| 3,779,023 | 12/1973 | Koppers | 61/45 D |
| 3,837,170 | 9/1974 | Martinko et al. | 61/45 D |
| 3,854,293 | 12/1974 | Spies | 61/45 D |

FOREIGN PATENTS OR APPLICATIONS

| | | | |
|---|---|---|---|
| 1,503,990 | 10/1967 | France | 61/45 D |
| 1,934,376 | 3/1970 | Germany | 61/45 D |
| 1,218,982 | 6/1966 | Germany | 61/45 D |
| 1,232,911 | 1/1967 | Germany | 61/45 D |
| 1,282,574 | 11/1968 | Germany | 61/45 D |

*Primary Examiner*—Dennis L. Taylor

*Attorney, Agent, or Firm*—Millen, Raptes & White

[57] ABSTRACT

A self-advancing chock for supporting the roof of the gallery of a mine near the working face utilizing one or more lever arms articulated to the forward portion of a base (nearer the working face) and to the rear portion of a roof-supporting cap. The cap has sufficient area to cover the other elements of the chock in all positions of the lever arms and may have a slightly concave upper surface. If two lever arms are used they may be rigidly or flexibly interconnected and the cap may be in two sections for use with sloping or irregular roof areas. The base element may also be in two sections.

14 Claims, 4 Drawing Figures

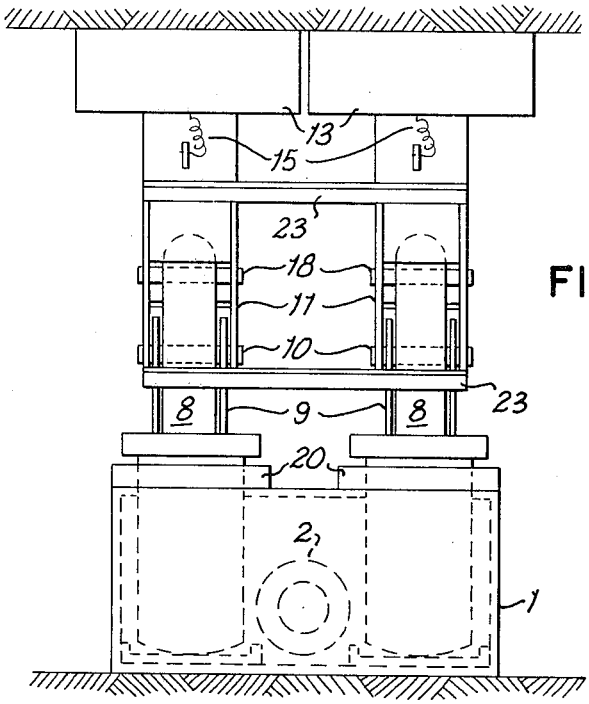
FIG. 3
FIG. 4
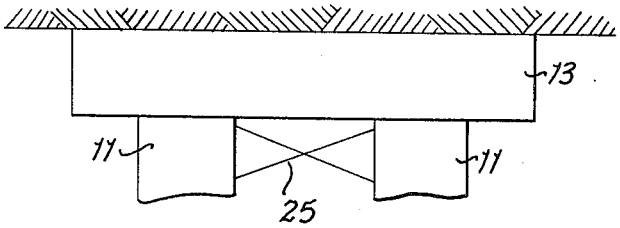

SELF ADVANCING SUPPORT CHOCKS

BACKGROUND OF THE INVENTION

The present invention is related to self-advancing support chocks useful in mines and various kind of workings to support the roof of galleries, more particularly in the neighbourhood of the mineral face behind the cutting machine.

Various types of self-advancing support chocks are known which, as a general rule, comprise a base element lying on the floor and supporting one or more props, each constituted by a ram with adjustable height and surmounted by a cap which, when the ram opens, applies itself to the roof of the gallery in order to support same. Among the various types of chocks, those called "shield or jib" chocks are more specially used to support the roof just behind the cutter in relatively low-quality grounds, with shales present and which give rise to important movements behind the opening made by the cutter, these movements tending to reduce considerably the distance between the floor and the roof of the gallery (convergence phenomenon). These chocks comprise a lever arm (shield or jib) articulated backwards on the base element and forwards on the cap, the ram (or rams) acting on this lever arm to push the cap against the roof, overhanging with respect to the front part of the chock, that is to say as close as possible to the mining face. The articulated lever arm acts as a multiplying device for the ram and thus permits an important vertical motion between the extreme positions of the cap (chock entirely opened and chock closed) to mitigate the great convergence between roof and floor. On the other hand, this arm also acts as a shield since it protects the chock from the rubbish which, due to the bad holding of the grounds, is under fragmented form.

In grounds having good cohesion, where the holding of the mining face is better and the convergence relatively smaller, shield chocks have a serious drawback. In such a kind of grounds, the roof collapses not in small pieces but as large and even very large slabs which, due to their weight, may crush the shield or at least damage it rapidly even if it is strongly stiffened. In order to obviate this drawback it is possible to break up the striking down, for example by blasting, but the working then becomes more costly and more dangerous.

SUMMARY OF THE INVENTION

The invention relates to a support chock which obviates the drawbacks of the shield chocks when working in grounds having good cohesion.

The self-advancing chock according to the invention comprises a base element supporting one or more props, each acting on a lever arm which is articulated on one end on the base element and on the other end on a cap, this chock being characterised by the fact that the articulation of the lever arm on the base element is located towards the front of said element in the direction of the mining face and that the articulation on the cap is located towards the back, the cap being placed so as to cover the whole chock.

The cap of the chock is unsymmetrical with respect to the articulation point with the lever arm, the front part having a length at least sufficient to cover, when the prop is closed, the articulation of the lever arm on the base and the rear part extending sufficiently over the back part of the base in order that the rubbish does not overrun the chock during the striking down. For the construction of the chock, the man skilled in the art will easily determinate the size of this rear part of the cap and, in particular, of the part that projects over the base according to the slope angle of the rubbish. The front part of the cap can project over or simply cover the lever arm articulation. In the latter case, the cap can be provided with extension pieces to support the part of the roof between its front part and the mining face. According to the mining conditions, there may be used resilient retractable extension blades, for example made of spring steel, or telescopic extension pieces with hydraulic lift such as described in French Pat. No. 1 303 511.

DESCRIPTION OF THE PREFERRED EMBODIMENT

The annexed drawings and the description hereunder will allow a better understanding of the characteristics and advantages of the invention.

FIG. 3 is a rear elevation of still another embodiment of a support chock according to the invention showing a divided cap.

FIG. 4 is a rear elevation of the top portion of the chock of FIGS. 1 and 2 of the support chock.

Figure 1:
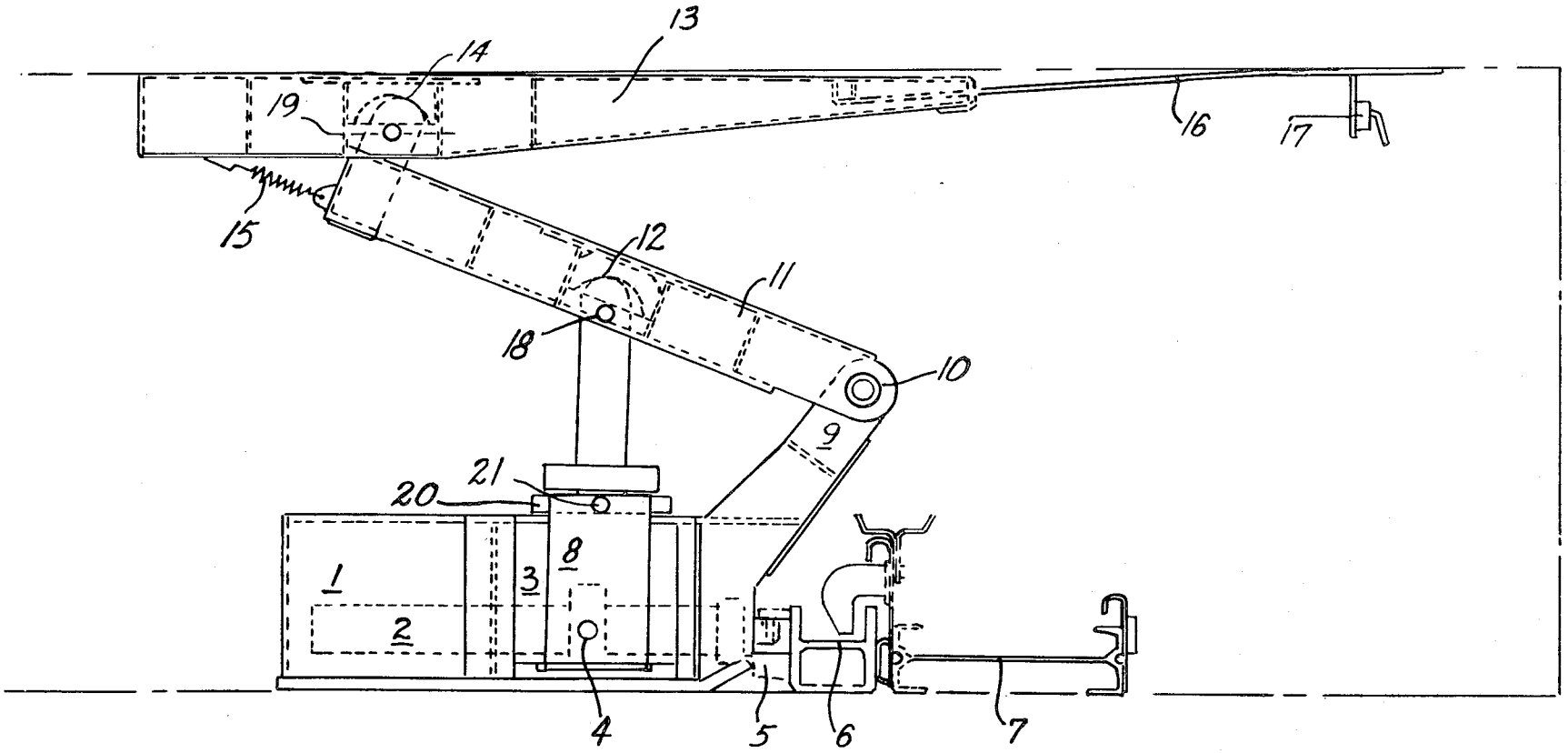
FIG. 1 is an elevation view of one embodiment of a support chock according to the invention.

In the perferred embodiment a single chock having two props is utilized, but it is to be understood that the invention can also be applied to mulilple chocks with two, three or more series.

The chock represented on the drawings rests on a one-piece base substantially rectangular 1 having a central tunnel in an axis of the base for receiving a moving ram 2 and includes two prop-holders 3 symmetrically disposed on each side of the central tunnel. In the chock as shown on the drawings, ram 2 is attached to the base by a cardan 4 so as to allow a maximum clearance and thus avoid any flexion of the ram rod during the moving of the chock. The ram can also be fixed to the base by a ball-and-socket joint, although in this case the risk of flexion is greater. The rod of ram 2 is attached at 5, by an axle, to a moving beam 6 against which an upturned portion of the base abuts to recenter itself. The use of the moving beam 6 is obviously not critical; it can be suppressed and the rod of ram 2 can be fixed directly to heavy steel conveyor 7 which must, in this case, be provided with a special raising element. According to another possible embodiment, the base is composed of two parts which are joined by an elastic system and which each supports a prop. Between the two parts is located a moving ram which acts as ram 2 described hereabove. The man skilled in the art can choose between the two kinds of base, either one- or two-pieces, according to the configuration of the worked grounds.

Figure 2:
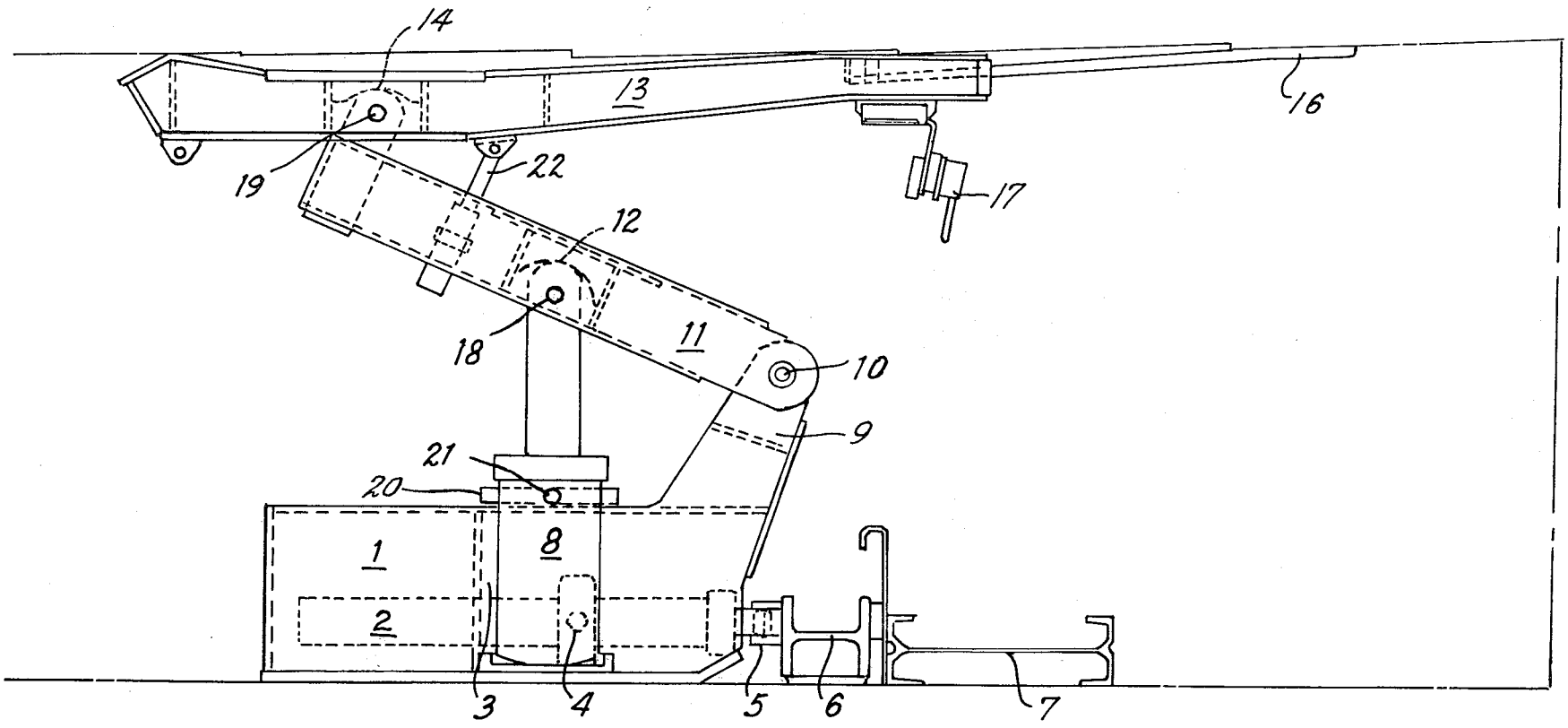
FIG. 2 is an elevation view of another embodiment of the chock, showing in particular a modification of the cap and another base element form.

Each prop-holder 3 supports a prop 8 constituted by a doubleeffect hydraulic ram. A tinned construction 9 is disposed at the front part of the base, in line with each prop 8. It can be largely overhanging with respect to the moving beam 6 as shown in FIG. 1 (or with respect to the heavy steel conveyor when the moving beam is missing). It can project slightly over the base as shown in FIG. 2 or be disposed plumb with the front part of the base. On an articulation axle 10 at the upper part of each structure 9 is articulated the lower extremity of a lever arm 11. Each lever arm articulates on corresponding prop 8 by a ball-and-socket joint 12 and supports at its higher extremity the cap 13 which can rotate around a ball-and-socket joint 14. As shown in FIG. 4 the cap 13 is preferably a one-piece element and articulates on the lever arm or arms 11, each of which rests on one of the props of the chock. According to a possible embodiment, each lever arm supports half a cap, both halves being optionally joined by a resilient system, such as for example spring blades 23, which allows a better tightening to the roof when the latter shows irregularities. When the cutting of the mineral by the cutting machine is irregular or made at variable height, steps can be formed in the roof. Due to the dissymmetry of the cap with respect to its articulation point, it is advantageous in this case to give to the upper surface of the cap a hollow shape 24 between back and front, in line with the articulation, as shown by FIG. 2. As an illustration only, for a cap of 25 cm thickness, it is advantageous to provide a cavity about 5 cm deep, which means that the cap is about 20 cm thick in line with the articulation. This hollow shape can be used as well for one-piece caps as for half-caps.

A spring 15 is fixed at one end to the under side of cap 13 and at the other end to the higher extremity of the lever arm(s) 11 in order to equilibrate the cap. This spring 15 can be replaced by an equilibrating ram with simple effect 22, its body being attached to lever arm 11 and its rod being attached under the front part of cap 13. When the heavy steel conveyor 7 is pushed ahead by ram 2, ram 22 is filled with hydraulic liquid: the withdrawal of the hydraulic liquid, which takes place through a construction of adjustable size, allows a control of the sinking speed of the cap when, at the loosening of the chock, the front part of the cap weighs on the ram rod with its hydraulic circuit on the way back. It is possible to use two symmetrical equilibrating rams, each attached to a lever arm, when a pair of lever arms 11 is being used, but one ram fixed on one of the two lever arms is generally sufficient to provide good balancing.

Resilient retractable extension pieces 16 lengthen the cap in the direction of the mining face and a control block 17 is suspended at one of the extension pieces (as shown FIG. 1) to command the working of the chock from the working alley. In the case of a one-piece cap, there may for example be three extension pieces at the front of the cap: a central one and two on each side plumb with the props. When extension pieces are not necessary, the control block is located at the front part of the cap.

The cap equilibrating devices (spring 15 or ram 22) are unnecessary when the cap can be self-balanced or when the hydraulic working of the support chocks is regulated from a neighbouring left or right chock. Such an indirect command is advantageous since the worker who moves the chocks is not under the cap of the loosened chock but under a cap tightened to the mining roof and maintaining same. In this case, the command block 17 is placed at the front part of the cap as shown FIG. 2.

The chock with two props described hereabove operates as follows. When the base 1 is at the right place, chosen according to the mining face, the rods of props 8 are hydraulically pushed out to open the chock and push the cap 13 to the roof. The back part of this cap which projects over the base 1 completely protects the chock during the striking down operation. When it is desired to move the chock, the rods of the props are hydraulically pushed back in order to loosen the cap from the roof, then the motion is performed by ram 2.

When the chock is closed, it is advantageous that the props be perpendicular to the base and the lever arms parallel to said base. Preferably, the maximum opening angle of the chock, i.e. the angle between the opening and closing position of the lever arms, is not larger than 30°. In these conditions, the motion of the cap in the direction of the mining face at the opening of the chock is sufficiently slight and thus not inconvenient. Likewise, when the chock is in service, the back motion of the cap is sufficiently slight so that the cap does not slide on the roof but on the contrary goes along with the natural movement of the roof towards back mining.

In the embodiment represented on the annexed drawings, corresponding to a warped roof and floor, the lever arms of the chock are articulated by axles to the base; in this case, each lever arm can be articulated on the base by one axle or two half-axles. The rods of the props support the lever arms by ball-and-socket joints, the return of the arms, when the prop rods go back, being effected through axles 18; likewise the lever arms support the caps by ball and socket joints with connection through axles 19. The return of the lever arms and their connection to the cap can also be made by cables. When the roof and the floor of the works have a normal convergence, the two lever arms can be interlocked, for example by braces 25 located at their lower parts, and the articulations between arms and props and cap can be simply made with axles. With interlocked lever arms, it is often preferred to have two half-caps rather than a one-piece cap so that the cap be less rigid. But when a better covering of the roof is requested, it is advantageous to use a one-piece cap. In these conditions, independent lever arms are preferably used to obviate abnormal twisting efforts at the articulations with the base and the props.

In the cuttings having a dip, it can be desired to use a device which brings the up-stream prop from down-stream to up-stream in a plane perpendicular to the walls of the lode. Any known device can be used, for example, a simple device such as a small bar (20 on the drawings) pushed up-stream against the prop by a simple effect hydraulic ram 21. At the loosening of the chock, the ram fills with hydraulic liquid and pushes the up stream prop to a neutral position. The liquid is then maintained in the ram by a non-return valve and a calibrated sliding valve in order to obviate the movements of the cap during the motion of the chock and to allow the tightening of the cap to the roof with the props parallel to each other, each in a plane perpendicular to the walls. After the tightening to the roof, the sliding valve allows the chock to follow without excessive constraint the oblique movements which may occur between roof and floor.

The present self-advancing support chock is useful in horizontal or moderately dipping veins. Due to the front-rear stability of the chock and to the risks of overrunning by the striking down rubbish, the cant towards the mining face or mining back should not exceed 10° and the longitudinal dip of the mining 30° to 35°.

What is claimed is:

1. A self-shielding support chock for use in mine galleries proximate the mining face in mines having horizontal or moderately dipping veins comprising:

a base;

a cap for interacting with the upper surface of the vein, said cap having sufficient area to cover the other elements of the chock when said cap is interacting with said upper surface;

at least one lever arm articulated at one end at a first articulation point on said base toward the front thereof in the direction of the mining face and articulated at the other end at a second articulation point on said cap toward the rear thereof away from the mining face; and a prop supported on said base, one end of said prop being in engagement with said at least one lever arm, said pro containing means for raising and lowering said at least one lever arm.

2. The support chock according to claim 1, wherein said cap is unsymmetrical with respect to said second articulation point, the forward portion of said cap with respect to said second articulation point having a length sufficient to cover the first articulation point when said lever arm is lowered by said prop.

3. The support chock according to claim 2 wherein the rear portion of said cap with respect to said second articulation point has a length sufficient to cover the corresponding portion of said base when said lever arm is lowered by said prop.

4. The support chock according to claim 1 also including means for self-advancing said chock.

5. The support chock according to claim 1 wherein said first articulation point includes at least one axle and said second articulation point includes a ball and socket joint and wherein said chock also includes a ball and socket joint interconnecting said prop and said lever arm.

6. The support chock according to claim 5 wherein said second articulation point also includes an axle and wherein said chock also includes an axle interconnecting said prop and said lever arm.

7. The support chock according to claim 1 including a pair of said lever arms and a corresponding pair of said props and also including means for interlocking said lever arms.

8. The support chock according to claim 1 including a pair of said lever arms and a corresponding pair of said props and wherein said cap is divided into two parts from front to rear and one of said lever arms with its corresponding prop is associated with each of said parts of said cap.

9. The support chock according to claim 1 wherein said cap includes a hollowed out portion between its forward edge toward the mining face and its rearward edge, said hollowed out portion extending laterally across the cap.

10. The support chock according to claim 8 wherein each of said parts of said cap includes a hollowed out portion between its forward edge toward the mining face and its rearward edge, said hollowed out portion extending laterally across each of said parts.

11. The support chock according to claim 1 also including a spring interconnecting said at least one lever arm and said cap rearwardly of said second articulation point for equilibrating said cap.

12. The support chock according to claim 8 also including a spring interconnecting each of said pair of lever arms and the part of said cap associated therewith rearwardly of said second articulation points for equilibrating said parts of said cap.

13. The support chock according to claim 1 also including a simple effect ram fixed to said lever arm and to said cap forwardly of said second articulation point.

14. The support chock according to claim 8 also including a simple effect ram fixed to at least one of each of said lever arms and to the associated part of said cap forwardly of said second articulation point.

* * * * *

UNITED STATES PATENT AND TRADEMARK OFFICE

CERTIFICATE OF CORRECTION

PATENT NO. : 3,991,579

DATED : November 16, 1976

INVENTOR(S) : PIERRE DEFFONTAINE

It is certified that error appears in the above-identified patent and that said Letters Patent are hereby corrected as shown below:

Claim 1, line 17: Change "pro" to -- prop --.

Signed and Sealed this

Twenty-second Day of March 1977

[SEAL]

*Attest:*

RUTH C. MASON
*Attesting Officer*

C. MARSHALL DANN
*Commissioner of Patents and Trademarks*